United States Patent [19]

Kocher et al.

[11] Patent Number: 4,722,580

[45] Date of Patent: Feb. 2, 1988

[54] TWO WAY COVER ASSEMBLY

[75] Inventors: Timothy L. Kocher, Harrisburg; Lahman D. Lambert, II; Earl W. McCleerey, both of Mechanicsburg; James P. Ward, Harrisburg, all of Pa.

[73] Assignee: AMP Incorporated, Harrisburg, Pa.

[21] Appl. No.: 894,388

[22] Filed: Aug. 11, 1986

Related U.S. Application Data

[63] Continuation of Ser. No. 239,270, Mar. 2, 1981, abandoned.

[51] Int. Cl.[4] ..... H01R 13/58

[52] U.S. Cl. ..... 439/466

[58] Field of Search ..... 339/103 R, 103 L, 103 M, 339/107

[56] References Cited

U.S. PATENT DOCUMENTS 3,622,943 11/1971 Reimer ..... 339/103
3,824,530 7/1974 Roberts et al. ..... 339/99 R
3,995,947 12/1976 Lightner et al. ..... 339/103 C X
4,108,527 8/1978 Douty et al. ..... 339/107

FOREIGN PATENT DOCUMENTS 1790336 4/1976 Fed. Rep. of Germany .
2215719 8/1974 France .
1175258 12/1969 United Kingdom .

*Primary Examiner*—Timothy V. Eley
*Attorney, Agent, or Firm*—Russel Egan; F. Brice Faller; David L. Smith

[57] ABSTRACT

A cover and strain relief assembly is disclosed for use with known elongated electrical connectors for providing either a 90° or 180° cable exit from the connector. The subject cover assembly has three pieces including a yoke that engages a mounting flange of the connector and a pair of mating panels which snap together engaging both the yoke and the cable. The mating panels can be reversibly connected, with respect to the manner in which they engage the yoke to yield a 90° or a 180° cable exit from the connector. The panels can further be provided with adjustable cable strain relief means.

16 Claims, 4 Drawing Figures

TWO WAY COVER ASSEMBLY

This application is a continuation of application Ser. No. 239,270, filed Mar. 2, 1981.

BACKGROUND OF THE INVENTION

1. The Field of the Invention

The present invention relates to a cover assembly for enclosing a rear portion of an electrical connector and providing a cable exit therefrom and in particular to an assembly which can provide alternate directions for a cable exiting from an electrical connector.

2. The Prior Art

In the past it has been usual practice to provide a cable cover for an electrical connector which cover has a fixed exit for the cable. Thus, it is not always possible to direct the cable away from the connector in the manner desired. Some covers do have means for varying the angle of cable exiting but these usually require a rather complex assembly of parts and do not always accomplish the desired angling effect. Examples of known cable directing covers may be found in the following U.S. Pat. Nos.:3,904,265; 3,995,947; 4,108,527; and 4,169,648.

SUMMARY OF THE INVENTION

The present invention relates to a cover assembly for an electrical connector which assembly allows directing an exiting cable either 90° or 180° from the connector. The subject cover assembly includes a yoke adapted to engage, from the rear, the mounting flange of the connector and a pair of mating cover members which are selectively secured together engaging both the yoke and the cable to provide the 90° or 180° cable exiting as desired.

It is therefore an object of the present invention to provide a cover assembly which can be readily mounted on an electrical connector without the use of any hardware.

It is a further object of the present invention to provide a cover assembly which will direct an exiting cable 90° or 180° from an electrical connector of known configuration.

It is yet another object of the present invention to provide a two way cable cover assembly for an electrical connector which cover assembly can be readily and economically manufactured.

The means for accomplishing the foregoing objects and other advantages of the present invention will become apparent to those skilled in the art from the following detailed description taken with reference to the accompanying drawings.

DETAILED DESCRIPTION OF THE PREFERRED EMBODIMENT

Figure 1:
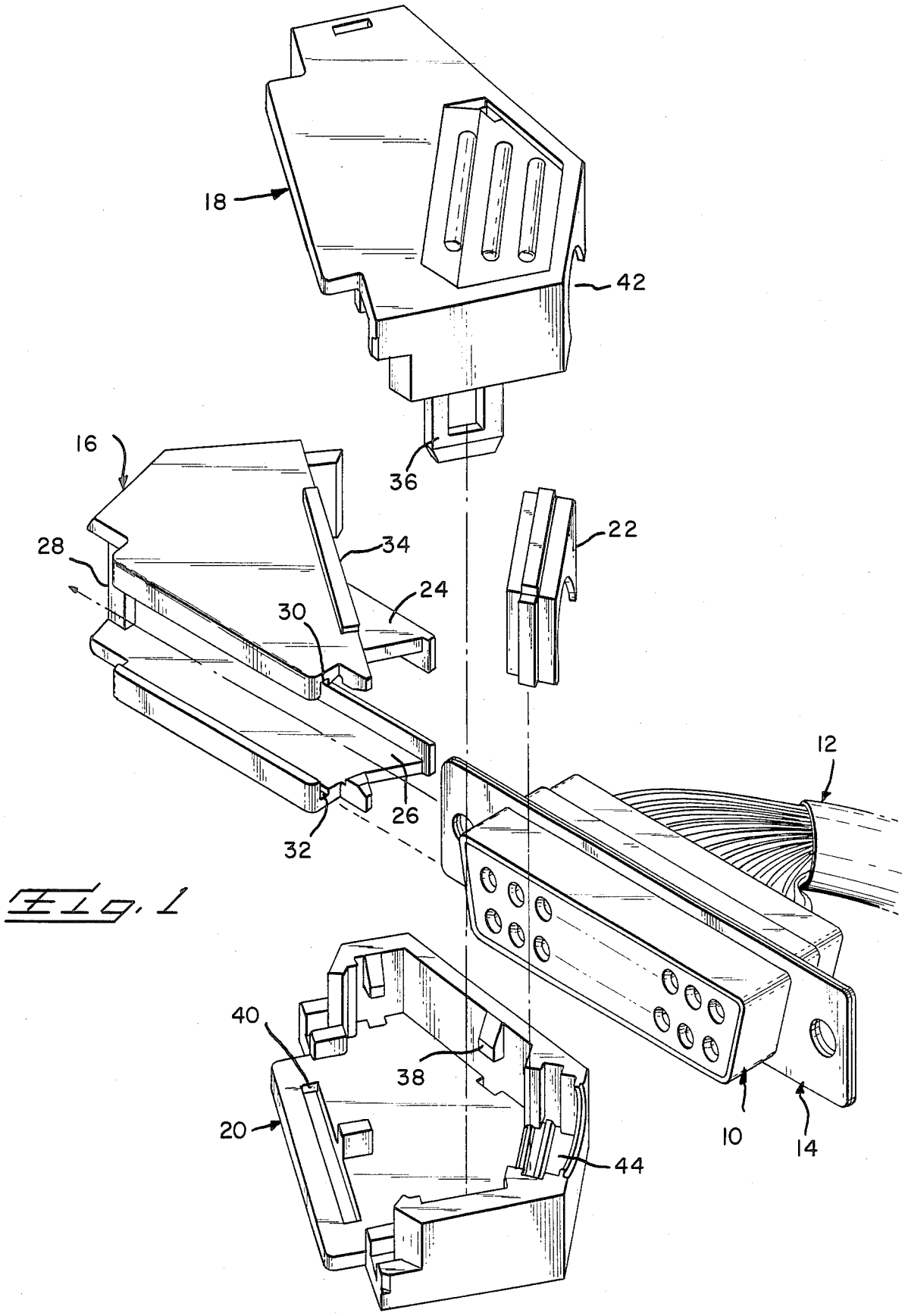
FIG. 1 is an exploded perspective view of a first embodiment of the subject cover assembly and a known electrical connector.

The subject cover assembly has been shown in combination with a known elongated electrical connector 10 of the type disclosed in U.S. Pat. No. 3,002,176 terminating a cable 12 in conventional manner. The connector 10 has a peripherial mounting flange 14. The cover assembly includes forward cover means in mounting yoke 16, rearward cover means in first cover member 18 and second cover member 20, and strain relief means including cable clamping member 22. The first embodiment of the yoke 16 is formed with a pair of spaced sidewalls 24, 26 joined by an intermediate wall 28 extending substantially normal to the planes of the sidewalls. The opposed faces of the sidewalls define first and second parallel, spaced, mounting flange receiving grooves 30, 32, respectively. Each sidewall also has, on the opposite, outwardly directed surface, an elongated mounting lug 34.

Mounting yoke 16 provides a connector face proximate grooves 30, 32 and a cable exit face, proximate mounting lugs 34. The connector face is at a selected angle with respect to the connector face with a passageway extending therebetween.

First and second cover members 18, 20 provide a forward face proximate elongate mounting lug 34 and a cable exit face proximate cable exit 42, 44. The forward face is at a selected angle with respect to the cable exit face with a passageway extending therebetween.

The first and second cover members 18, 20 have latching means 36, 38 for detachably securing the cover members together in known fashion. They further each have an elongated groove 40 each of which receives a respective and similarly elongated lug 34 of the yoke 16. Each cover member also includes a cable exit 42, 44 at least one of which can be profiled to receive therein a cable sizing and gripping member 22.

Figure 2:
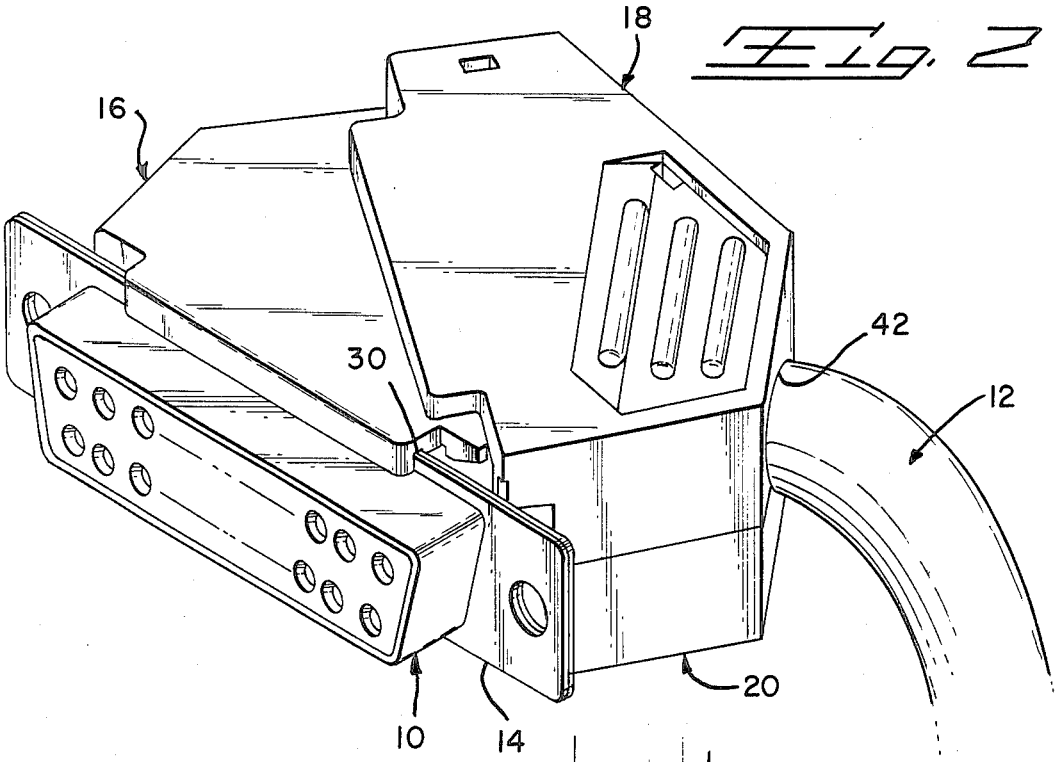
FIG. 2 is a perspective view of the first embodiment of the subject cover assembly engaging the known connector to provide a 90° cable exiting.
Figure 3:
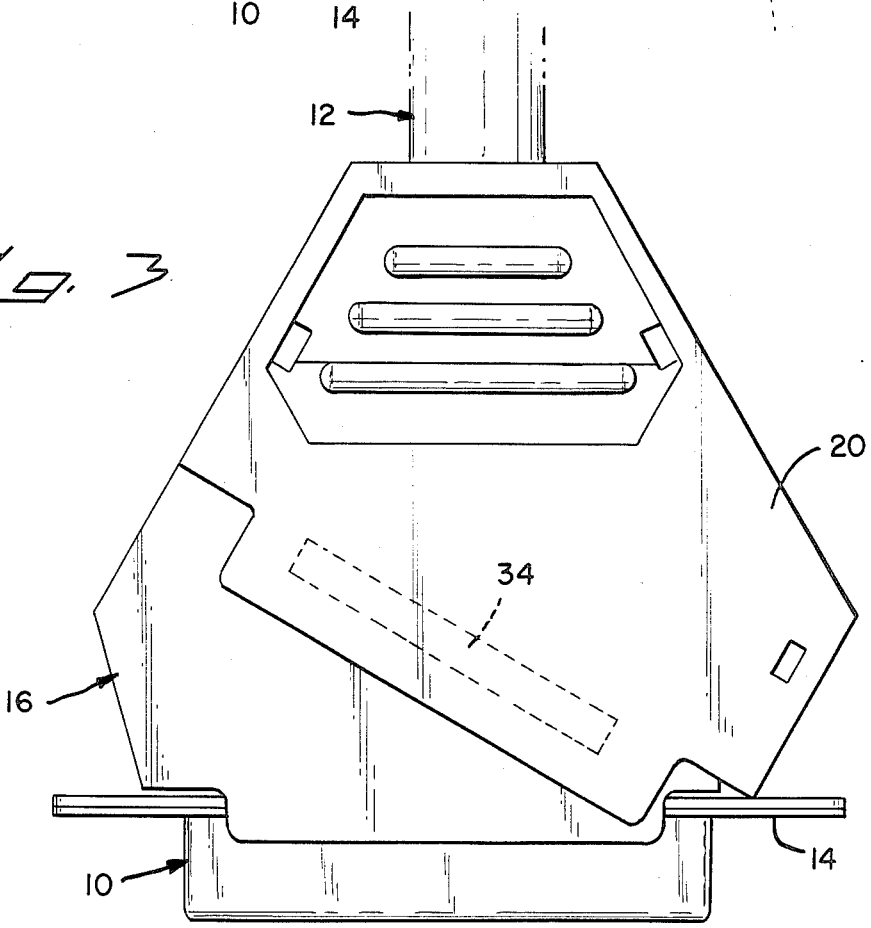
FIG. 3 is a plan view of the first embodiment of the subject cover assembled to provide 180° exiting of the cable from the connector.

The subject cover assembly is mounted on a known electrical connector by first sliding the yoke 16 over the connector 10 so that edge portions of the peripherial flange 14 of the connector lie in the respective grooves 30, 32. Yoke 16 will slide over connector 10 in either of two orientations. The wall 28 will form an abutment limiting the insertion of the connector 10 into the yoke 16 to properly position the yoke 16 with respect to the connector 10. The covers 18 and 20 are then provided with the proper sizing element 22, if used, and snapped together in either of the two configurations as shown in FIGS. 2 and 3 to provide the desired cable exiting. If cover 18 is on the top, as shown in FIG. 1, the result will be 90° cable exiting as shown in FIG. 2. If cover 20 is placed on top, using the FIG. 1 orientation of the yoke 16, then the result will be 180° cable exiting as shown in FIG. 3.

Figure 4:
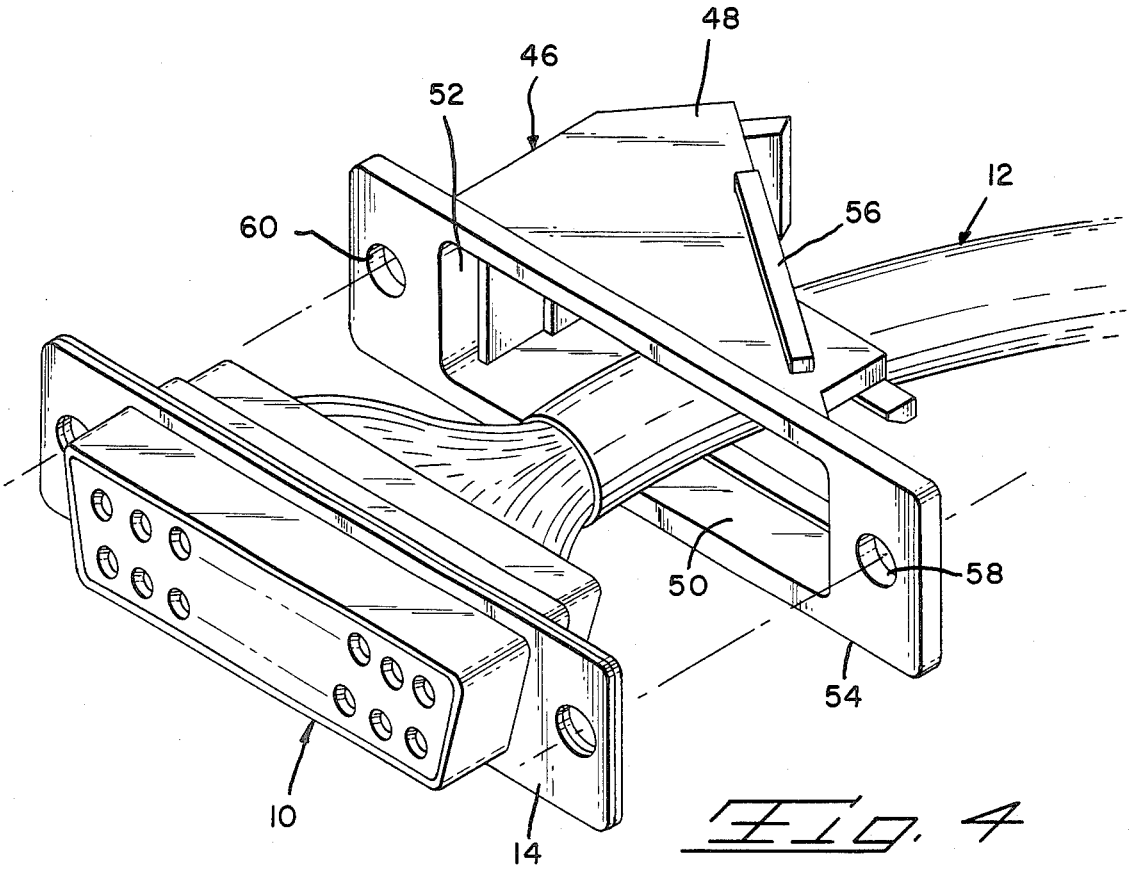
FIG. 4 is an exploded perspective view of an alternate embodiment of a yoke member for the subject cover assembly.

An alternate embodiment of the yoke 46 is shown in FIG. 4. This embodiment has a pair of spaced sidewalls 48, 50 joined by an intermediate wall 52, extending normal to the planes of the sidewalls, and a peripherial flange 54 extending from aligned edges of the sidewalls. The sidewalls are also provided with outwardly directed elongated mounting lugs 56. The flange 54 includes mounting apertures 58, 60 aligned with like mounting apertures in the connector.

The operation of this embodiment of the yoke 46 is similar to yoke 16. This yoke 46 would be assembled with the connector 10 by bringing the flanges 14, 54 into abutment and securing them together by known means (not shown). The covers 18, 20 would then be applied as before.

The present invention may be subject to many modifications and changes without departing from the spirit or essential characteristics thereof. The present embodiments should therefore be considered in all respects as illustrative and not restrictive of the scope of the invention.

What is claimed is:

1. A two way cover assembly for an electrical connector comprising:

a yoke member having a pair of parallel spaced sidewalls joined along one marginal edge by an intermediate end wall extending transversely to the planes of said sidewalls, said sidewalls each having connector engaging means along a second marginal edge and an elongated lug on an outward surface of each said sidewall extending along a third marginal edge and lying at an angle with respect to said connector engaging means, and a pair of mating panel members each having an inwardly directed face with an elongated lug engaging groove therein, means to detachably secure said panels together, and a cable exit, whereby engagement of said grooves of said panel members on said lugs of said yoke provides a cable exit in a first direction and reversing said panel members to opposite sides of said yoke provides a cable exit in a second direction.

2. A two way cover assembly according to claim 1 wherein said connector engaging means comprises:

a groove in the inward surface of each sidewall in opposing spaced parallel relationship to receive therein a peripherial mounting flange portion of said connector.

3. A two way cover assembly according to claim 1 wherein said connector engaging means comprises:

a peripherial flange integral with said sidewalls and extending normal to the planes of said sidewalls along said second marginal edge, said flange adapted to abut a like mounting flange on said connector.

4. A two way cover assembly according to claim 1 further comprising:

cable sizing and gripping means received in said cable exit of at least one of said mating panel members.

5. A two way cover assembly according to claim 1 wherein said means to detachably secure said panels together comprises:

latching means on one said panel member positioned to engage lug means on the other said panel member.

6. In combination with an elongated electrical connector having a peripherial mounting flange, a two way cover assembly providing cable exiting from said connector in either of two directions spaced 90° apart, said cover assembly comprising:

a yoke member having a pair of parallel spaced walls joined by an intermediate end wall extending normal to the planes of said sidewalls, connector engaging means on each said sidewall engaging said mounting flange of said connector, and a pair of oppositely outwardly directed elongated mounting lugs lying parallel to each other at an angle with respect to said connector engaging means; and a pair of mating panel members, each having an inwardly directed face with an elongated lug engaging groove therein, means to detachably secure said panel members together, and a cable exit, whereby engagement of said panel members on respective sides of said yoke member provides a cable exit in a first direction and engagement of said panel members on opposite sides of said yoke member provides a cable exit in a second direction 90° removed from said first direction.

7. A two way cover assembly according to claim 6 wherein said connector engaging means comprises:

a groove in the inward surface of each sidewall in opposing spaced parallel relationship to receive therein a peripherial mounting flange portion of said connector.

8. A two way cover assembly according to claim 6 wherein said connector engaging means comprises:

a peripherial flange integral with said sidewalls and extending normal to the planes of said sidewalls along said second marginal edge, said flange adapted to abut a like mounting flange on said connector.

9. A two way cover assembly according to claim 6 further comprising:

cable sizing and gripping means received in said cable exit of at least one of said mating panel members.

10. A two way cover assembly according to claim 6 wherein said means to detachably secure said panel members together comprises:

latching means on one said panel member positioned to engage lug means on the other said panel member.

11. A multiple orientation cable exit cover assembly for an electrical connector terminated to a cable, comprising:

forward cover means including means for securely engaging an electrical connector, rearward cover means including cable strain relief means, and means for securing said rearward cover means to said forward cover means;

said forward cover means having a connector face, a cable exit face disposed at a selected angle to said connector face, and a passageway extending between said connector face and said cable exit face, said forward cover means adapted to be secured to said connector in at least two angular orientations with said connector face parallel to a mating face of said connector;

said rearward cover means having a forward face, a cable exit face disposed at a selected angle to said forward face thereof, and a passageway extending between said forward face and said cable exit face, said cable strain relief means being disposed proximate said cable exit face, said rearward cover means adapted to be secured by said cover securing means to said forward cover means in at least two angular orientations with said forward face parallel to said cable exit face of said forward cover means, whereby angular orientations of said forward cover means with respect to said connector, and of said rearward cover means with respect to said forward cover means, can be selected such that said cable may exit the assembly of said connector and said forward and rearward cover means in any of a plurality of directions.

12. A cable exit cover assembly as set forth in claim 11 wherein both an aperture defined in said cable exit face of said forward cover means, and an aperture defined in said forward face of said rearward cover means are substantially larger than the diameter of said cable, whereby conductors of said cable are able to be spaced apart within said large apertures and said passageways to extend to respective spaced apart terminal passageways of said connector.

13. A cable exit cover assembly as set forth in claim 11 wherein said rearward cover means comprises a pair of opposed rearward cover members having latch means for being secured together, said forward cover means includes lugs extending outwardly from opposed side surfaces thereof along said cable exit face, and said rearward cover members include a recess into an inside surface of a side wall thereof along said forward face for receiving a respective one of said lugs thereinto during latching of said rearward cover members together, thereby securing said rearward cover means to said forward cover means with said forward face parallel to said cable exit face of said forward cover means.

14. A cable exit cover assembly as set forth in claim 13 wherein said connector engaging means comprises recesses into opposed inside surfaces of said forward cover means extending along said connector face for receiving thereinto respective opposed edge portions of a flange of said connector, said flange being parallel to said mating face thereof, thereby securing said connector to said forward cover means with said connector face parallel to said connector mating face.

15. A cable exit cover assembly as set forth in claim 14 wherein said forward cover means is an integral member having opposed panel portions joined by a side wall along corresponding first sides thereof, and corresponding second sides thereof define a connector receiving opening, said flange receiving recesses extend along said connector face from said connector receiving opening, and said rearward cover means is adapted to close off said connector receiving opening after said connector has been received thereinto when said rearward cover means is secured to said forward cover member, thereby securing said forward and rearward cover means to said connector.

16. A cable exit cover assembly as set forth in claim 13 wherein said cable strain relief means comprises a cable clamping surface of said cable exit means of one of said rearward cover members cooperable with an opposed cable clamping surface of a member inserted into a recess of said cable exit means of the other of said rearward cover members, whereby said cable is clampingly engaged by both said cable engaging surfaces upon said rearward cover members being secured together.

* * * * *

UNITED STATES PATENT OFFICE

CERTIFICATE OF CORRECTION

Patent No. 4,722,580 Dated February 2, 1988

Inventor(s) Timothy L. Kocher, Lahman D. Lambert, II, Earl W. McCleerey, and James P. Ward It is certified that error appears in the above-identified patent and that said Letters Patent is hereby corrected as shown below:

Claim 13, Column 5, Line 13 - insert the word --each-- after the word "members".

Signed and Sealed this

Twenty-eighth Day of April, 1992

*Attest:*

HARRY F. MANBECK, JR.

*Attesting Officer*

*Commissioner of Patents and Trademarks*